United States Patent [19]

Richardson, Jr.

[11] Patent Number: 4,997,349

[45] Date of Patent: Mar. 5, 1991

[54] LUBRICATION SYSTEM FOR THE CRANK MECHANISM OF A SCROLL COMPRESSOR

[75] Inventor: Hubert Richardson, Jr., Brooklyn, Mich.

[73] Assignee: Tecumseh Products Company, Tecumseh, Mich.

[21] Appl. No.: 417,236

[22] Filed: Oct. 5, 1989

[51] Int. Cl.[5] ..... F04C 18/04; F04C 29/02

[52] U.S. Cl. ..... 418/55.5; 418/55.6; 418/94

[58] Field of Search ..... 418/55 E, 88, 94, 55 D

[56] References Cited

U.S. PATENT DOCUMENTS

| | | | |
|---|---|---|---|
| 4,462,772 | 7/1984 | Hazaki et al. | 418/94 |
| 4,502,852 | 3/1985 | Hazaki | 418/94 |
| 4,551,082 | 11/1985 | Hazaki et al. | 418/94 |
| 4,585,403 | 4/1986 | Inaba et al. | 418/55 D |
| 4,655,697 | 4/1987 | Nakamura et al. | 418/57 |
| 4,702,681 | 10/1987 | Inaba et al. | 418/94 |

FOREIGN PATENT DOCUMENTS

| | | | |
|---|---|---|---|
| 58-160582 | 9/1983 | Japan | 418/55 E |
| 59-224494 | 12/1984 | Japan | 418/94 |
| 60-135691 | 7/1985 | Japan | 418/55 E |

*Primary Examiner*—John J. Vrablik

*Attorney, Agent, or Firm*—Jeffers, Hoffman & Niewyk

[57] ABSTRACT

A hermetic scroll compressor is disclosed including within a hermetically sealed housing a fixed scroll member, an orbiting scroll member, and rotatable crankshaft operably coupled to the orbiting scroll member by an eccentric crank mechanism. The crank mechanism includes an eccentric crankpin on the end of the crankshaft, a cylindrical roller having an off-center bore in which the crankpin is received, and a cylindrical well formed on the bottom of the orbiting scroll member into which the roller and crankpin assembly are received. An axial oil passageway in the crankshaft delivers oil from an oil sump directly to the interfaces between bearing surfaces of the crankpin, roller, and orbiting scroll member by means of radial oil passages in both the crankpin and roller. The radial passages are located at a central location along the axial length of the interfaces, and are either in line at the interface between the crankpin and roller, or are staggered 180 degrees.

20 Claims, 3 Drawing Sheets

LUBRICATION SYSTEM FOR THE CRANK MECHANISM OF A SCROLL COMPRESSOR

BACKGROUND OF THE INVENTION

The present invention relates generally to a hermetic scroll-type compressor and, more particularly, to such a compressor including an eccentric drive mechanism for drivingly engaging the orbiting scroll member, wherein the drive mechanism includes a crankpin and roller assembly coupled to the orbiting scroll member.

A typical scroll compressor comprises two mutually facing scroll members, each having an involute wrap, wherein the respective wraps interfit to define a plurality of compression pockets. When one of the scroll members is orbited relative to the other, the pockets travel in a radial direction, e.g., from a radially outer suction port to a radially inner discharge port, to convey and compress a refrigerant fluid.

The orbiting scroll member is drivingly engaged by an eccentric crank mechanism to impart orbiting motion thereto. Generally, the crank mechanism is associated with a rotating crankshaft driven by an electric drive motor. More specifically, in a crank mechanism to which the present invention is applicable, the upper end of the rotating crankshaft includes an eccentric crankpin that is drivingly coupled to the bottom surface of the orbiting scroll member. The orbiting scroll member is prevented from rotating about its own axis by a conventional Oldham ring assembly cooperating between the scroll member and a stationary frame member.

During operation of a scroll-type compressor, the pressure of compressed refrigerant at the interface between the scroll members tends to force the scroll members axially and radially apart, thereby permitting high-to-low pressure leakage between compression pockets that reduces the operating efficiency of the compressor. Consequently, axial and radial compliance of the orbiting scroll member toward the fixed scroll member is required in order to maintain the scroll members in sealing contact with one another. Various methods for achieving such axial and radial compliance have been developed, and are widely used in scroll-type compressors.

In the aforementioned eccentric crank mechanism to which the present invention pertains, a swing-link radial compliance mechanism is incorporated. Specifically, the eccentric crankpin on the crankshaft is received within an axial bore extending through a cylindrical roller at an off-center location thereof, whereby the roller is eccentrically journalled about the eccentric crankpin. The roller and crankpin assembly is then received within a cylindrical well formed on the bottom surface of the orbiting scroll member, whereby upon rotation of the crankshaft the orbiting scroll member is caused to orbit. The roller pivots slightly about the crankpin so that the crank mechanism functions as a radial compliance mechanism to promote sealing engagement between the involute wraps of the scroll members.

In the aforementioned eccentric crank mechanisms, and particularly those incorporating a crankpin and roller swing-link radial compliance mechanism, it is desirable to minimize friction at the interfaces between the crankpin, roller, and orbiting scroll member bearing surfaces in order to reduce power losses in the compressor and to prevent overheating and failure of the bearings.

Presently, the bearing surfaces of the crankpin, roller, and orbiting scroll member are lubricated with oil from the oil sump of the hermetic compressor by splashing the oil onto the top axial end of the interfaces between the members. Consequently, oil flows by gravity into the respective interfaces. In the aforementioned crank mechanism wherein the crankpin and roller assembly are received within a well in the bottom surface of the orbiting scroll member, an axial oil passageway extends through the crankpin and has an opening on the axial end of the crankpin adjacent the bottom surface of the well. Oil is delivered into the well and then flows into the previously described interfaces, aided in some instances by flats on the bearing surfaces.

Several problems are possible in the aforementioned lubrication system relating to an eccentric drive mechanism incorporating a swing-link radial compliance mechanism. For instance, oil supplied to the axial end of the bearing surface interfaces may be otherwise vented away without entering the interface. Also, oil entering an axial end of the bearing interfaces may not travel the full axial distance, or may increase in temperature over the axial distance, thereby affecting the quality of lubrication over the axial distance of the bearing interface.

SUMMARY OF THE INVENTION

The present invention overcomes the problems and disadvantages of the above-described prior art scroll-type compressor having an eccentric drive mechanism incorporating a swing-link radial compliance mechanism by providing an improved lubrication system therefor, wherein oil is supplied directly to the bearing interfaces between the crankpin, roller, and orbiting scroll member, whereby the supply of oil to the bearing interfaces is increased, thereby reducing power consumption by the compressor.

Generally, the present invention provides a scroll compressor mechanism within a sealed housing having an oil sump therein. The scroll compressor mechanism includes an orbiting scroll member operably coupled to a rotatable crankshaft by means of an eccentric drive mechanism. The drive mechanism includes a cylindrical well on the bottom surface of the orbiting scroll member and an eccentric crankpin on the end of the crankshaft. A cylindrical roller member is rotatably received in the well, and includes a bore in which the crankpin is pivotally received. A first bearing interface between the crankpin and the roller member and a second bearing interface between the roller member and the orbiting scroll member are lubricated by oil from the oil sump. The oil is delivered to the interfaces by means of an axial oil passageway in the crankshaft and a pair of radial oil passages, one extending between the axial oil passageway and the first interface and the other extending through the roller member between the first and second interfaces.

More specifically, the present invention provides, in one form thereof, for lubrication of the aforementioned first and second bearing interfaces by delivering oil directly to an axially intermediate location of the interface, whereby oil may migrate more uniformly over the entire bearing interface. According to different aspects of the present invention, the pair of radial oil passages in the crankpin and roller member, respectively, are either in line with one another at their mutual bearing interface or are diametrically opposite one another.

An advantage of the lubrication system of the present invention is that the supply of oil to the bearing surfaces of an eccentric drive mechanism are significantly increased.

Another advantage of the lubrication system of the present invention is that the power consumed by the compressor is reduced as a result of improved lubrication of the eccentric drive mechanism.

A further advantage of the lubrication system of the present invention is that lubricating oil is delivered directly to the bearing interfaces between the crankpin, roller, and orbiting scroll member of an eccentric drive mechanism constituting a swing-link radial compliance mechanism.

Yet another advantage of the lubrication system of the present invention is that lubricating oil is distributed more evenly over the axial length of the bearing interfaces between the crankpin, roller, and orbiting scroll member of an eccentric drive mechanism constituting a swing-link radial compliance mechanism.

A still further advantage of the lubrication system of the present invention, in one form thereof, is that bearing surfaces of an eccentric drive mechanism are adequately lubricated even in the presence of an oil vent that returns oil to the oil sump.

The invention, in one form thereof, provides a hermetic compressor for compressing refrigerant fluid, including a housing having a scroll compressor mechanism and an oil sump therein. The scroll compressor mechanism includes an orbiting scroll member having a cylindrical well formed therein, which is operably driven by a rotatable crankshaft. The crankshaft includes a radially extending plate portion and an eccentric crank portion extending axially from an end surface of the plate portion. A cylindrical roller member has a bore in which the crank portion is received such that the roller member is pivotally circumjacent the crank portion. The roller member is rotatably journalled within the well of the orbiting scroll member to impart orbiting motion thereto upon rotation of the crankshaft. The crank portion and roller member define a first bearing interface therebetween and the roller member and orbiting scroll member define a second bearing interface therebetween. An oil delivery arrangement delivers oil from the oil sump to the first and second bearing interfaces by means of a first generally axial oil passageway in the crankshaft which is in fluid communication with the oil sump. A first radial oil passage in the crank portion provides fluid communication between the axial oil passageway and the first bearing interface, while a second radial oil passage in the roller provides fluid communication between the first bearing interface and the second bearing interface.

The invention further provides, in one form thereof, a hermetic scroll compressor for compressing refrigerant fluid, including a housing having an oil sump therein. A scroll compressor mechanism within the housing includes an orbiting scroll member having a cylindrical well formed therein. The well has a cylindrical side wall and a bottom wall. There is also provided a roller member including a cylindrical outer surface intermediate a pair of end surfaces. The roller member is rotatably received within the well such that the cylindrical side wall of the well and the cylindrical outer surface of the roller member establish a first cylindrical bearing interface therebetween. Also, the bottom wall of the well and an adjacent one of the pair of end surfaces establish a closed oil chamber. A cylindrical bore extends through the roller member between the pair of end surfaces. A rotatable crankshaft includes a radially extending plate portion and an eccentric cylindrical crankpin extending axially from an end surface of the plate portion. The crankpin is pivotally received within the cylindrical bore of the roller member to impart orbiting motion to the orbiting scroll member upon rotation of the crankshaft. The crankpin and the cylindrical bore establish a second cylindrical bearing interface therebetween. Oil is delivered from the oil sump to the first and second bearing interfaces by means of a first generally axial oil passageway in the crankshaft providing fluid communication between the oil sump and the closed oil chamber. More specifically, a first radial oil passage in the crankpin extends between the axial oil passageway and the first bearing interface, and a second radial oil passage in the roller member extends between the first bearing interface and the second bearing interface. An oil vent is providing for venting oil from the closed oil chamber back to the oil sump.

DESCRIPTION OF THE PREFERRED EMBODIMENT

Figure 1:
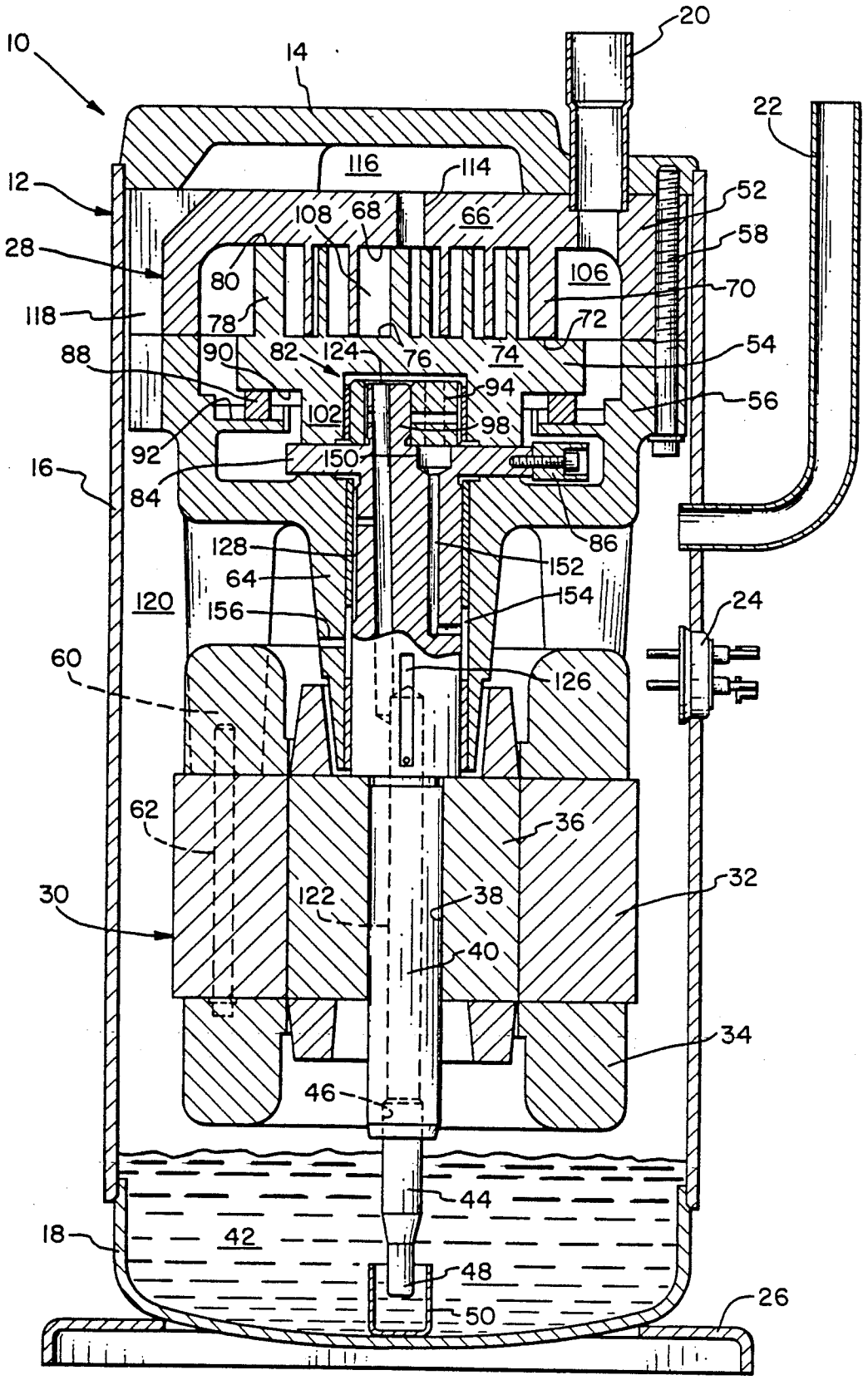
FIG. 1 is a longitudinal sectional view of a scroll-type compressor of the type to which the present invention pertains.

Referring now to the drawings, there is shown a hermetic scroll-type compressor 10 of the type to which the present invention is applicable. Compressor 10 includes a housing 12 having a top cover plate 14, a central portion 16, and a bottom portion 18, all of which are hermetically joined, as by welding. Housing 12 includes a suction inlet 20, a discharge outlet 22, and an electrical terminal cluster 24. A mounting flange 26 is welded to bottom portion 18 for mounting the housing in a vertically upright position.

Disposed within housing 12 is a motor-compressor unit comprising a scroll compressor mechanism 28 and an electric motor 30. Motor 30 includes a stator 32 having windings 34, and a rotor 36 having a central aperture 38 into which a crankshaft 40 is secured by an interference fit. An oil sump 42 is provided generally in the bottom portion of housing 12. A centrifugal oil pickup tube 44 is press fit into a counterbore 46 in the lower end of crankshaft 40. Pick-up tube 44 is of conventional construction, and may optionally include a vertical paddle (not shown) enclosed therein. An oil inlet end 48 of pickup tube 44 extends downwardly into the open end of a cylindrical oil cup 50, which provides a quiet zone from which high quality, non-agitated oil may be drawn.

Compressor mechanism 28 generally comprises a fixed scroll member 52, an orbiting scroll member 54, and a frame member 56. As shown in FIG. 1, fixed scroll member 52 and frame member 56 are secured together and are attached to top cover plate 14 by means of a plurality of mounting bolts 58. Frame member 56 includes a plurality of mounting pads 60 to which motor stator 32 is attached by means of a plurality of mounting bolts 62, such that there is an annular gap between stator 32 and rotor 36. Frame member 56 also includes a bearing portion 64 in which crankshaft 40 is rotatably journalled.

With continued reference to FIG. 1, fixed scroll member 52 comprises a generally flat plate portion 66 having a face surface 68, and an involute fixed wrap 70 extending axially from surface 68 and having a wrap tip surface 72. Likewise, orbiting scroll member 54 comprises a generally flat plate portion 74 having a top face surface 76, and an involute orbiting wrap 78 extending axially from surface 74 and having a wrap tip surface 80. Fixed scroll member 52 and orbiting scroll member 54 are operably intermeshed such that wrap tip surfaces 72, 80 of wraps 70, 76 sealingly engage with respective opposite face surfaces 74, 68 along a respective sliding interface therebetween.

The upper end of crankshaft 40 includes an eccentric drive mechanism 82, which drivingly engages the underside of orbiting scroll member 54. Crankshaft 40 also includes a thrust plate 84, intermediate orbiting scroll member 54 and frame member 56, to which is attached a counterweight 86. Orbiting scroll member 54 is prevented from rotating about its own axis by means of a conventional Oldham ring assembly, comprising an Oldham ring 88, and Oldham key pairs 90, 92 associated with orbiting scroll member 54 and frame member 56, respectively.

Figure 2:
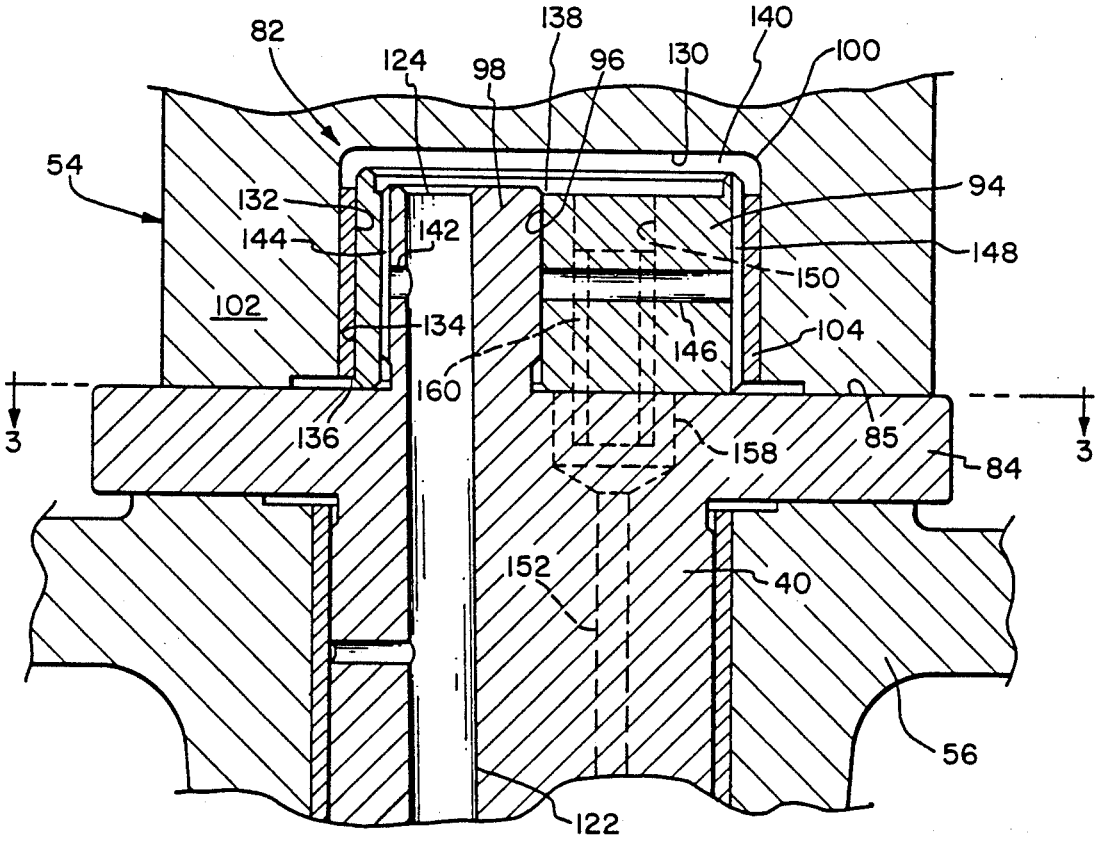
FIG. 2 is an enlarged fragmentary sectional view of the compressor of FIG. 1, in accordance with one embodiment of the invention.
Figure 3:
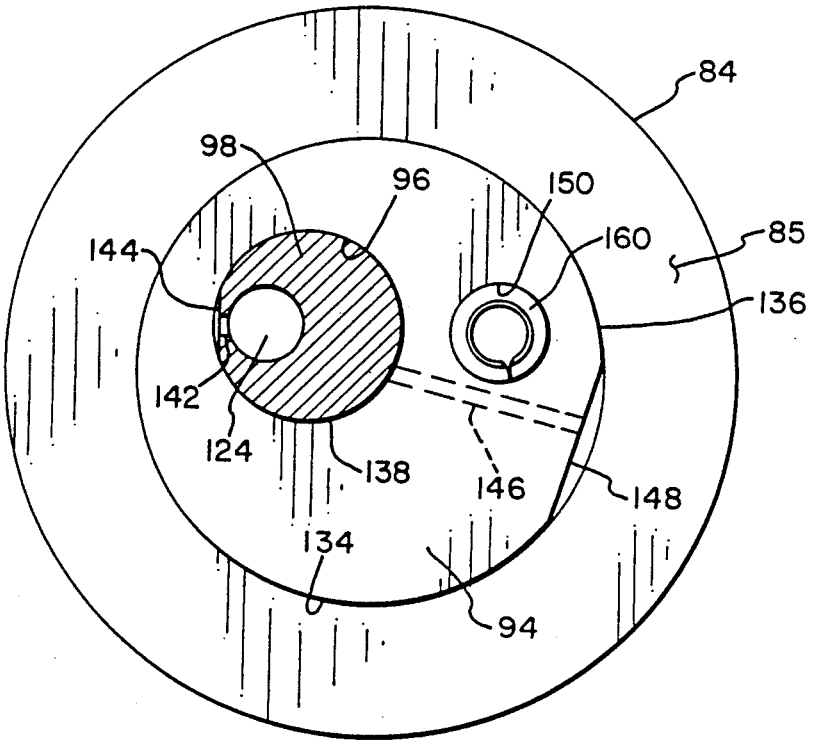
FIG. 3 is an enlarged top view of the crankshaft and eccentric crank mechanism of the compressor of FIG. 1, taken along the line 3—3 in FIG. 2 and viewed in the direction of the arrows, including a crankpin and roller lubrication system in accordance with one embodiment of the present invention.

Referring to FIGS. 1–3, eccentric drive mechanism 82 comprises a cylindrical roller 94 having an axial bore 96 extending therethrough at an off-center location. An eccentric crankpin 98 on the upper end of crankshaft 40 extends axially upwardly from a top surface 85 of thrust plate 84 and is received within bore 96, whereby roller 94 is eccentrically journalled about eccentric crankpin 98. Roller 94 and crankpin 98 are received within a cylindrical well 100 defined by a lower hub portion 102 on the bottom of orbiting scroll member 54. Roller 94 is journalled for rotation within well 100 by means of a sleeve bearing 104, which is press fit into well 100. Sleeve bearing 104 is preferably a steel-backed bronze bushing.

When crankshaft 40 is rotated by motor 30, the operation of eccentric crankpin 98 and roller 94 within well 100 causes orbiting scroll member 54 to orbit with respect to fixed scroll member 52. Roller 94 pivots slightly about crankpin 98 so that eccentric drive mechanism 82 functions as a conventional swing-link radial compliance mechanism to promote sealing engagement between fixed wrap 70 and orbiting wrap 78. The lubrication of eccentric drive mechanism 82, in accordance with the present invention, will be more particularly described hereinafter in connection with a discussion of the lubrication system of compressor 10.

In operation of compressor 10 within a conventional refrigeration system (not shown), refrigerant fluid at suction pressure is introduced through suction inlet 20 into a suction pressure chamber 106, which is in fluid communication with a radially outer portion of a compression interface 108 defined intermediate operably intermeshed fixed and orbiting scroll members 52 and 54. As orbiting scroll member 54 is caused to orbit, refrigerant fluid is compressed radially inwardly to a radially inner portion of compression interface 108 and is discharged upwardly through a discharge port 114. The compressed refrigerant then passes through a discharge plenum chamber 116 and a duct 118 before entering a discharge pressure space 120 defined within housing 12.

Compressor 10 generally includes a lubrication system which supplies oil from oil sump 42 to various locations in the compressor requiring lubrication, e.g., crankshaft bearings. More specifically, crankshaft 40 includes a generally axial oil passageway 122 extending from counterbore 46 on the lower end of the crankshaft to an opening 124 on the top of crankpin 98 at the upper end of the crankshaft. Upon rotation of crankshaft 40, oil pick-up tube 44 pumps oil through passageway 122 to flats 126 and 128 formed in crankshaft 40 at intermediate locations thereof journalled within bearing portion 64. Oil pumped through passageway 122 is also used to lubricate eccentric drive mechanism 82, as will now be described in accordance with the present invention.

Referring to FIGS. 2 and 3, well 100 formed in orbiting scroll member 54 includes a bottom wall 130 and a cylindrical side wall 132. For illustration purposes, the inner cylindrical surface of sleeve bearing 104 constitutes cylindrical side wall 132 of well 100. Side wall 132 and an outer cylindrical surface 134 of roller 94 establish a cylindrical bearing interface 136 therebetween having axial length essentially equal to the axial dimension of roller 94. Likewise, a cylindrical bearing interface 138 is established between crankpin 98 and bore 96, wherein interface 138 also has axial length essentially equal to the axial dimension of roller 94.

As shown in FIG. 2, a closed oil chamber 140 is defined by bottom wall 130 of well 100 and the end surfaces of roller 94 and crankpin 98. Closed oil chamber 140 is in fluid communication with axial oil passageway 122 by means of opening 124 on the end of crankpin 98. Also, cylindrical bearing interfaces 136 and 138 intersect with closed oil chamber 140 at their respective upper ends. The respective lower ends of cylindrical bearing interfaces 136 and 138 open adjacent top surface 85 of thrust plate 84.

Crankpin 98 includes a radial oil passage 142 extending between axial oil passageway 122 and an axially extending flat 144 on the outer cylindrical surface of the crankpin, whereby passage 142 supplies lubrication to cylindrical bearing interface 138. Likewise, roller 94 includes a radial oil passage 146 extending between bore 96 and an axially extending flat 148 on outer cylindrical surface 134, Whereby passage 146 supplies lubrication to cylindrical bearing interface 136. In the preferred embodiment disclosed herein, radial oil passages 142 and 146 extend generally horizontally and communicate with their associated cylindrical bearing interfaces at a central location along the axial lengths thereof. Accordingly, oil from axial oil passageway 122 is delivered directly to a central location of cylindrical bearing interfaces 136 and 138.

It will be appreciated that the word "radial", as used herein to describe the oil passages in the crankpin and the roller, i.e., oil passages 142 and 146, is generally understood to include any oil passage that provides fluid communication between a radially inner location of the crankpin or roller and a respective radially outer location thereof. For instance, radial oil passage 142 extends between axial oil passageway 124 and a radially outer surface of the crankpin. Likewise, radial oil passage 146 extends between bore 96 and a radially outer surface of the roller.

In the embodiment of FIG. 3, the respective locations at which radial oil passages 142 and 146 communicate with bearing interface 138 are circumferentially spaced. Accordingly, oil delivered into bearing interface 138 through oil passage 142 must flow around the cylindrical interface before entering into oil passage 146 for delivery to bearing interface 136.

Figure 4:
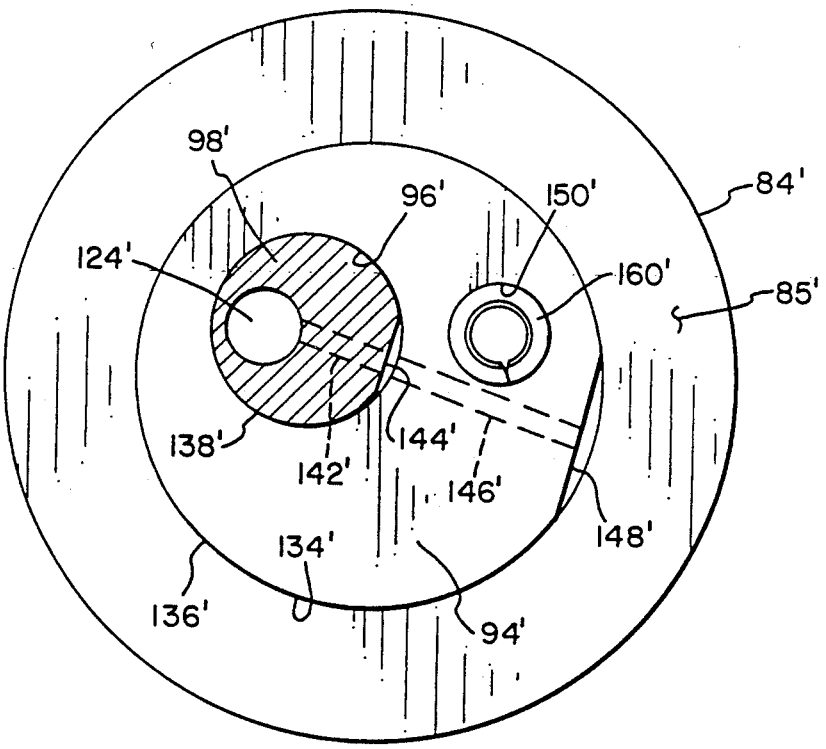
FIG. 4 is a top view of a crankshaft and eccentric crank mechanism of the type shown in FIG. 3, including a crankpin and roller lubrication system in accordance with an alternative embodiment of the present invention.

FIG. 4 illustrates an alternative embodiment of the present invention in which the orientation of the radial oil passages is changed from that of the embodiment of FIG. 3, wherein in FIG. 4 like elements are indicated by primed like reference numerals.

Referring to FIG. 4, oil passages 142' and 146' are generally aligned. More specifically, oil passage 146' communicates with that portion of bearing interface 138' defined by flat 144' and an arc portion of bore 96'. In this manner, oil is more directly delivered to both bearing interfaces, despite slight pivotal movement of roller 94' relative to crankpin 98'.

The lubrication system of compressor 10 further includes a vent for returning the oil that is pumped from sump 42 to closed oil chamber 140 back to the sump. Specifically, an axially extending vent bore 150 is provided in roller 94 and provides communication between the top and bottom surfaces thereof. An axial vent passageway 152 extends axially through crankshaft 40 to communicate between top surface 85 of thrust plate 86 and an annular space 154 circumjacent the crankshaft. A vent hole 156 extending through bearing portion 64 provides fluid communication between annular space 154 and housing space 120.

In order to maintain fluid communication between vent bore 150 and vent passageway 152 when roller 94 pivots slightly with respect crankpin 98, the upper portion of passageway 152 adjacent top surface 85 of thrust plate 86 comprises a pocket 158 having a diameter greater than that of vent bore 150. As shown in FIG. 2 and 3, a hollow roll pin 160 is press fit into vent bore 150 and extends from the bottom of roller 94 into the void defined by pocket 158. Oil may continue to flow through roll pin 160 to maintain fluid communication between vent bore 150 and vent passageway 152; however, roller 94 is restrained from pivoting completely about crankpin 98. This restraint against pivoting is used primarily during assembly to keep roller 94 within a range of positions to ensure easy assembly of orbiting scroll member 54 and fixed scroll member 52.

It will be appreciated that the foregoing description of a preferred embodiment of the invention is presented by way of illustration only and not by way of any limitation, and that various alternatives and modifications may be made to the illustrated embodiment without departing from the spirit and scope of the invention.

What is claimed is:

1. A hermetic scroll compressor for compressing refrigerant fluid, comprising:

a housing;

an oil sump within said housing;

a scroll compressor mechanism within said housing, said mechanism including an orbiting scroll member having a cylindrical well formed therein;

a rotatable crankshaft including a radially extending plate portion and an eccentric crank portion extending axially from an end surface of said plate portion;

a cylindrical roller member including a bore in which said crank portion is received such that said roller member is pivotally circumjacent said crank portion, said roller member being rotatably journalled within said well to impart orbiting motion to said orbiting scroll member upon rotation of said crankshaft, said crank portion and said roller member defining a first bearing interface therebetween and said roller member and said orbiting scroll member defining a second bearing interface therebetween; and oil delivery means for delivering oil from said oil sump to said first and second bearing interfaces, said means including a first generally axial oil passageway in said crankshaft in fluid communication with said oil sump, a first radial oil passage in said crank portion providing fluid communication between said axial oil passageway and said first bearing interface, and a second radial oil passage in said roller member providing fluid communication between said first bearing interface and said second bearing interface.

2. The hermetic scroll compressor of claim 1 in which:

said crank portion comprises a generally cylindrical crankpin having an axially extending flat portion on an outer cylindrical surface thereof with which said first radial oil passage communicates.

3. The hermetic scroll compressor of claim 2 in which:

said second radial oil passage communicates with a portion of said first bearing interface defined by said flat portion of said crankpin and said roller member.

4. The hermetic scroll compressor of claim 2 in which:

said cylindrical roller member includes a generally cylindrical outer surface having an axially extending flat portion with which said second radial oil passage communicates.

5. The hermetic scroll compressor of claim 1 in which:

said cylindrical roller member includes a generally cylindrical outer surface having an axially extending flat portion with which said second radial oil passage communicates.

6. The hermetic scroll compressor of claim 1 in which:

said first and second radial oil passages communicate with said first bearing interface at a central location along the axial length thereof, and said second radial oil passage communicates with said second bearing interface at a central location along the axial length thereof.

7. The hermetic scroll compressor of claim 1 in which:

said bore in said roller member is located at an eccentric location thereof, whereby a swing-link radial compliance mechanism is provided for said scroll compressor mechanism.

8. The hermetic scroll compressor of claim 1 in which:

said first and second radial oil passages are generally aligned, whereby substantially unimpeded oil flow is provided from said first radial oil passage to said second radial oil passage.

9. The hermetic scroll compressor of claim 1 in which:

said first and second radial oil passages are circumferentially spaced with respect to said first bearing interface, whereby oil flows from said first radial oil passage to said second radial oil passage through said first bearing interface.

10. A hermetic scroll compressor for compressing refrigerant fluid, comprising:

a housing;

an oil sump within said housing;

a scroll compressor mechanism within said housing, said mechanism including an orbiting scroll member having a cylindrical well formed therein, said well having a cylindrical side wall and a bottom wall;

a roller member including a cylindrical outer surface intermediate a pair of end surfaces, said roller member being rotatably received within said well such that said cylindrical side wall of said well and said cylindrical outer surface of said roller member establish a first cylindrical bearing interface therebetween, and said bottom wall of said well and an adjacent one of said pair of end surfaces establish a closed oil chamber, said roller member including a cylindrical bore extending therethrough between said pair of end surfaces;

a rotatable crankshaft including a radially extending plate portion and an eccentric cylindrical crankpin extending axially from an end surface of said plate portion, said crankpin being pivotally received within said cylindrical bore of said roller member to impart orbiting motion to said orbiting scroll member upon rotation of said crankshaft, said crankpin and said cylindrical bore establishing a second cylindrical bearing interface therebetween;

oil delivery means for delivering oil from said oil sump to said first and second cylindrical bearing interfaces, said means including a first generally axial oil passageway in said crankshaft providing fluid communication between said oil sump and said closed oil chamber, a first radial oil passage in said crankpin extending between said axial oil passageway and said second cylindrical bearing interface, and a second radial oil passage in said roller member extending between said first cylindrical bearing interface and said second cylindrical bearing interface; and oil venting means for venting oil from said closed oil chamber to said oil sump.

11. The hermetic scroll compressor of claim 10 in which:

said crankpin includes an axially extending flat portion on an outer cylindrical surface thereof with which said first radial oil passage communicates; and said second radial oil passage communicates with a portion of said first cylindrical bearing interface defined by said flat portion of said crankpin and said roller member.

12. The hermetic scroll compressor of claim 11 in which:

said cylindrical outer surface of said roller member includes an axially extending flat portion with which said second radial oil passage communicates.

13. The hermetic scroll compressor of claim 10, wherein said first and second cylindrical bearing interfaces have respective axial lengths, in which:

said first and second radial oil passages communicate with said second cylindrical bearing interface at a central location along said axial length thereof, and said second radial oil passage communicates with said first cylindrical bearing interface at a central location along said axial length thereof.

14. The hermetic scroll compressor of claim 10 in which:

said cylindrical bore in said roller member is located at an eccentric location thereof, whereby a swing-link radial compliance mechanism is provided for said scroll compressor mechanism.

15. The hermetic scroll compressor of claim 10 in which:

said first and second radial oil passages are generally aligned, whereby substantially unimpeded oil flow is provided from said first radial oil passage to said second radial oil passage.

16. The hermetic scroll compressor of claim 10 in which:

said first and second radial oil passages are circumferentially spaced with respect to said second cylindrical bearing interface, whereby oil flows from said first radial oil passage to said second radial oil passage through said second cylindrical bearing interface.

17. The hermetic scroll compressor of claim 10 in which:

said oil venting means comprises a second generally axial oil passageway in said crankshaft, and a vent oil passage extending through said roller member to provide fluid communication between said closed oil chamber and said second axial oil passageway.

18. A vertical hermetic scroll compressor for compressing refrigerant fluid, comprising:

a vertically upstanding housing including an oil sump located generally at the bottom of said housing;

a scroll compressor mechanism within said housing, said mechanism including an orbiting scroll member, said orbiting scroll member including a top surface having an involute wrap element thereon and a bottom surface having a downwardly opening cylindrical well formed therein, said well having a cylindrical side wall and a bottom wall;

a roller member including a top end surface, a bottom end surface, and an intermediate cylindrical outer surface, said roller member being rotatably received within said well such that said cylindrical side wall of said well and said cylindrical outer surface of said roller member establish a first cylindrical bearing interface therebetween, and said bottom wall of said well and said top end surface of said roller member establish an upper closed oil chamber, said roller member including a cylindrical bore extending therethrough between said top and bottom end surfaces;

a crankshaft rotatable about a vertical axis and including a radially extending plate portion and an eccentric crankpin extending axially upwardly from said plate portion, said crankpin being pivotally received within said cylindrical bore of said roller member to impart orbiting motion to said orbiting scroll member upon rotation of said crankshaft, said crankpin and said cylindrical bore establishing a second cylindrical bearing interface therebetween, said first and second cylindrical bearing interfaces intersecting with said upper closed oil chamber; and oil delivery means for delivering oil from said oil sump to said first and second cylindrical bearing interfaces, said means including a first generally axial oil passageway in said crankshaft providing fluid communication between said oil sump and said upper closed oil chamber, a first radial oil passage in said crankpin extending between said axial oil passageway and said second cylindrical bearing interface at a central location along the axial length thereof, and a second radial oil passage in said roller member extending between said first and second cylindrical bearing interfaces at respective central locations along the axial lengths thereof.

19. The vertical hermetic scroll compressor of claim 18, and further comprising:

oil venting means for venting oil from said upper closed oil chamber to said oil sump.

20. The vertical hermetic compressor of claim 18 in which:

said crankpin includes an axially extending flat portion on an outer cylindrical surface thereof with which said first radial oil passage communicates; and said cylindrical outer surface of said roller member includes an axially extending flat portion with which said second radial oil passage communicates.

* * * * *